US006142244A

United States Patent [19]

Hesse

[11] Patent Number: 6,142,244

[45] Date of Patent: Nov. 7, 2000

[54] PERCUSSION BORING MACHINE WITH RUN MONITORING

[75] Inventor: Alfons Hesse, Lennestadt, Germany

[73] Assignee: Tracto-Technik Paul Schmidt Spezialmachinen, Lennestadt, Germany

[21] Appl. No.: 08/982,330

[22] Filed: Dec. 2, 1997

[30] Foreign Application Priority Data

Dec. 4, 1996 [DE] Germany ..... 196 50 271

[51] Int. Cl.[7] ..... E21B 47/01; E21B 7/26

[52] U.S. Cl. ..... 175/45; 175/26; 73/152.03

[58] Field of Search ..... 175/26, 45, 296, 175/297, 414, 417; 73/152.03, 152.99, 152.43, 152.46, 152.47, 152.48, 152.49, 152.51

[56] References Cited

U.S. PATENT DOCUMENTS

| | | | |
|---|---|---|---|
| 2,973,471 | 2/1961 | Armistead et al. | 73/152.49 |
| 3,746,106 | 7/1973 | McCullough et al. | 340/853.5 |
| 4,674,579 | 6/1987 | Geller et al. | 175/45 |
| 4,875,292 | 10/1989 | Gibson | 33/304 |
| 5,010,965 | 4/1991 | Schmelzer | 175/19 |
| 5,350,254 | 9/1994 | Fisk et al. | 175/67 |
| 5,448,911 | 9/1995 | Mason | 73/152.47 |
| 5,490,569 | 2/1996 | Brotherton et al. | 175/45 |
| 5,526,886 | 6/1996 | Jenne | 175/45 |
| 5,597,046 | 1/1997 | Fisk | 175/45 |

FOREIGN PATENT DOCUMENTS

| | | |
|---|---|---|
| 357 314 | 10/1988 | European Pat. Off. . |
| 0 361 805 | 9/1989 | European Pat. Off. . |
| 343 800 | 11/1989 | European Pat. Off. . |
| 0 617 193 | 9/1994 | European Pat. Off. . |
| 0 622 519 | 11/1994 | European Pat. Off. . |
| 703 345 | 7/1995 | European Pat. Off. . |
| 0 709 541 | 5/1996 | European Pat. Off. . |
| 2 157 259 | 11/1972 | Germany . |
| 88 00 034 | 7/1988 | Germany . |
| 43 09 387 | 3/1993 | Germany . |
| 42 30 624 | 3/1994 | Germany . |
| WO 94/05941 | 3/1994 | WIPO . |

*Primary Examiner*—Eileen D. Lillis
*Assistant Examiner*—John Kreck
*Attorney, Agent, or Firm*—Merchant & Gould P.C.

[57] ABSTRACT

In a percussion boring machine having run monitoring a measuring and transmitting unit and an above-ground receiver the pneumatically or hydraulically driven and controlled striking piston (3) reciprocates between the tip of the machine and a rear stop (8). In order to expose the measuring and transmitting unit as little as possible to the influence of the ram blows acting on the tip of the machine, it is arranged so that (when viewed in the direction of advance) it is in front of the rear stop.

16 Claims, 3 Drawing Sheets

PERCUSSION BORING MACHINE WITH RUN MONITORING

FIELD OF THE INVENTION

The invention relates to a percussion boring machine for forming earth boreholes which for the purpose of run monitoring is provided with a built-in measuring and transmitting unit the signals from which are received by an above-ground receiver.

BACKGROUND AND PRIOR ART

Percussion boring machines are principally used for laying service lines, especially underground pipelines, without trench-digging, and require run monitoring and control means which allow the machine to be guided accurately to its target. Thus the machine must go round obstructions in the ground. If not, these, like differing soil formations, often lead to directional deviations which need careful correction, since otherwise the target may be missed by a large amount, particularly over long distances. Further, problems arise in the event of unevenness in the ground surface which does not allow the percussion boring machine to be guided at a constant distance from the surface, since the machine would then follow the irregularities of the surface.

In order to avoid the above-mentioned difficulties, it is, for example, known from EP-A 0 617 193 to fit a transmitter in the striking tip or in a displacing head. The transmitter is Located immediately in front of the front wall of the machine housing to which the striking piston which reciprocates in the machine housing imparts its whole impact energy at high frequency. Accordingly the transmitter is subjected to extremely high mechanical stresses, which necessitate costly measures to provide adequate protection of the transmitter from damage.

A further disadvantage of such head-mounted transmitters is that the tip of the machine is the most highly stressed part, and has to be made correspondingly stable and connected securely to the housing. This is particularly true in the case of a striking tip which is guided to be axially movable in the machine housing. The transmitter is therefore only accessible with difficulty, and as a result is difficult to maintain and repair.

Furthermore the tip of the machine serves to penetrate and break through stones and the soil, and it is therefore subjected to severe stresses from the surrounding ground.

An earth boring machine provided with a transmitter for run monitoring is already known from U.S. Pat. No. 4,674,579, but this is not propelled by dynamic impact means, so that less mechanical stress of the transmitter is involved. Nevertheless in this machine the transmitter is not located in the head but in the front part of the rear third of the machine housing. As a result of its length, the transmitter requires, just as in the case of the transmitter located in the head of the percussion boring machine according to EP-A 0 617 193, a not inconsiderable amount of space, which is necessarily associated with a corresponding increase in the length of the machine. However, in the case of percussion boring machines for laying lines, especially pipelines, without trench digging the length of the machine represents a particular problem, since laying the pipes mostly takes place from a starting pit. For such a starting pit there is usually little space available, for example in front gardens, under sidewalks or in existing inspection chambers. As result the machine has to be as short as possible in order to manage with narrow starting pits. The same applies analogously to the target pit.

OBJECT OF THE INVENTION

The objects of the invention are therefore first of all to keep the mechanical stress to which the sensitive measuring and transmitting unit is subjected as low as possible and, in cases in which the conditions of use make it necessary, to keep the machine as short as possible.

SUMMARY OF THE INVENTION

To this end, the transmitter is on the one hand fitted as far as possible from the striking tip. For this a position before the rear stop for the striking piston (when viewed in the direction of advance) is best suited. The transmitter is then practically outside the machine housing, for example where the connection is made between the machine housing and a follower pipe. Such an arrangement simultaneously solves—at least in part—the problem of the additional space required, for the transmitter can be located in the interior of a hollow cylindrical connecting piece or of a ring for the follower pipe: it may be cast into the ring.

However, the axial space required is also reduced if the transmitter, the measuring unit and the associated battery are arranged side by side and not, as usual, one behind the other. Thus the transmitter, the battery, the measuring unit and also further parts may, for example, be arranged around the axis of the machine in the form of a collar.

In order to decrease the impact stress, the transmitter should be embedded in an elastic body, preferably of silicone or polyurethane. The machine housing may be closed off in the region of the transmitter by a cover of plastics material through which the transmitter signal can pass, or, in the region of the transmitter, slots for the transmitter signals may be provided in the steel parts surrounding the transmitter.

In order to improve the targeting accuracy, the measuring unit is preferably equipped with a clinometer, by means of which it is possible to determine whether there are changes is direction in the vertical plane, for example in the vicinity of surface unevennesses or obstructions or changing strata in the ground.

Favourable conditions for maintenance and repair exist when the transmitter is located in an annular insert which merely needs to be pushed into the likewise annular connecting piece for a follower pipe and fixed there.

BRIEF DESCRIPTION OF THE DRAWINGS

The invention will now be described in more detail by way of example with reference to an embodiment shown in the drawings, in which.

DETAILED DESCRIPTION OF A PREFERRED EMBODIMENT OF THE INVENTION

Figure 1:
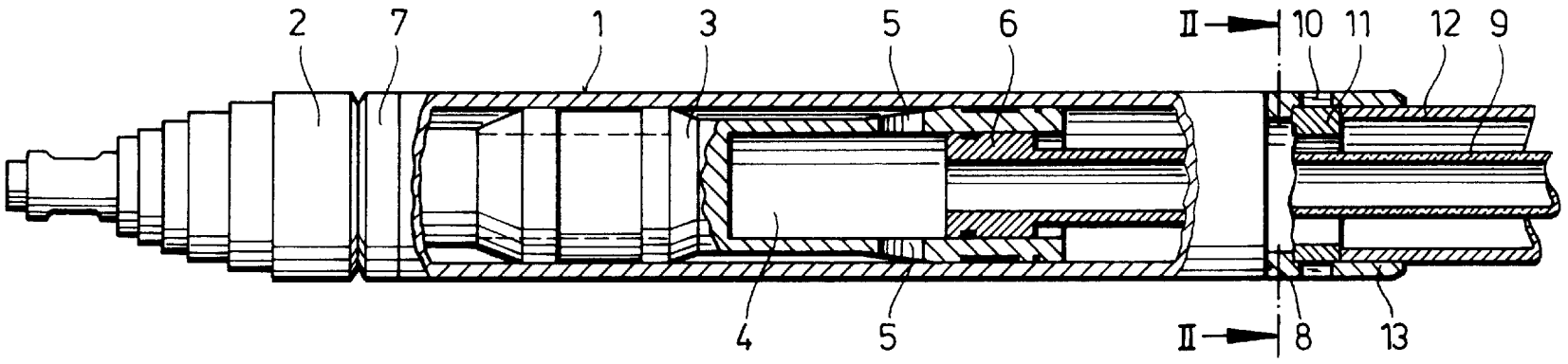
FIG. 1 shows a percussion boring machine having a transmitter fitted at the rear end of the machine.
Figure 2:
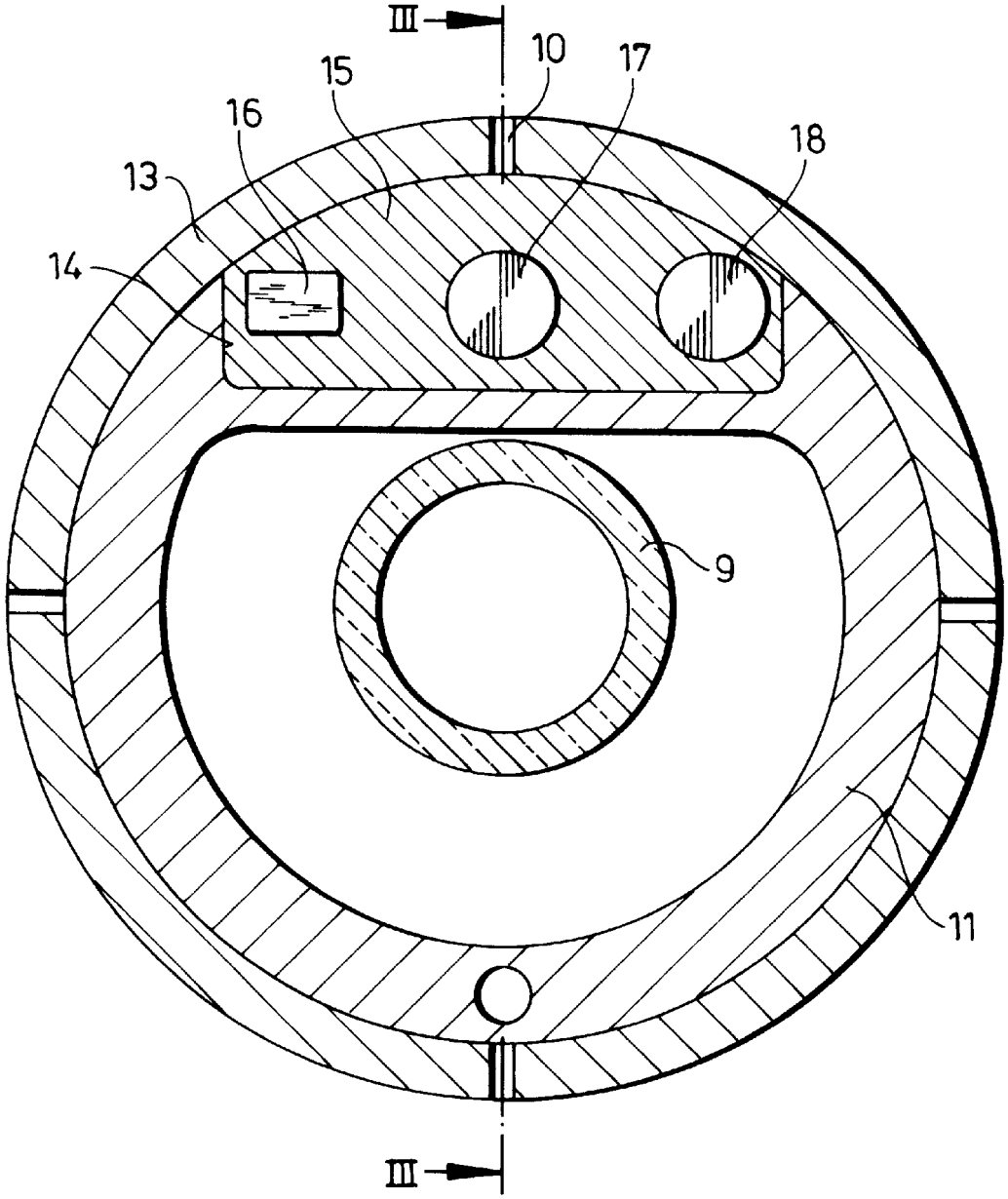
FIG. 2 shows a cross-section through the housing on the line II—II in FIG. 1.
Figure 3:
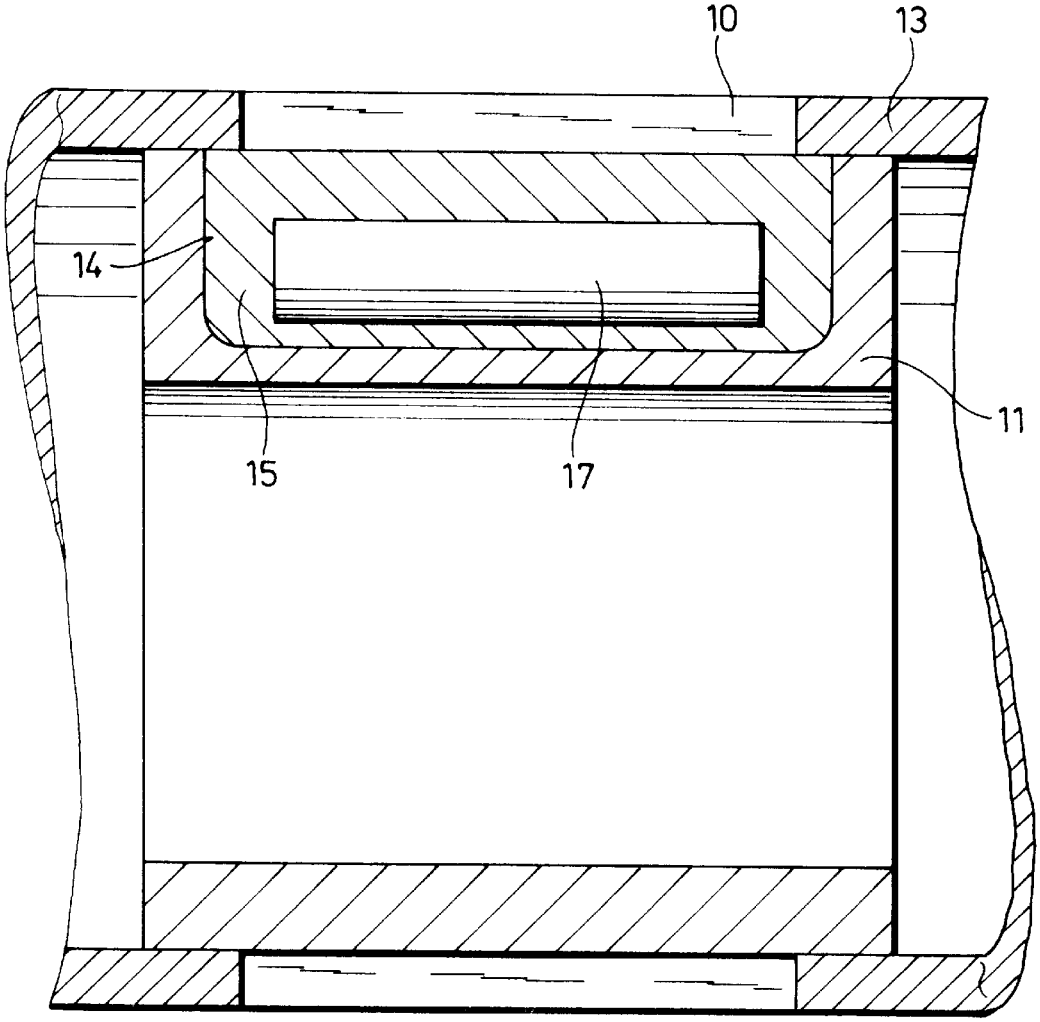
FIG. 3 shows an axial longitudinal section on the line III—III in FIG. 2.

In its design principle and method of operation the percussion boring machine corresponds to the machine described in German patent specification 21 57 295. It has a housing 1 with an impact tip 2 and a striking piston 3. The striking piston 3 has in its rear part a compressed air chamber 4 with radial control openings 5 and is guided to move longitudinally on a control pipe 6 in the machine housing 1. It gives up its impact energy when it meets the front end wall 7 of the machine housing 1. In the rear part of the machine housing there is a stop ring 8 through which the control pipe 6 projects and is connected to a compressed air hose 9 on the far side of the stop ring. Immediately behind the stop ring 8 there is a slot 10 in a sleeve 13 connected to the machine housing in the vicinity of which an annular insert 11 is located. The slot 10 can be closed by means of a cap or have a non-conductive mass which does not hinder the transmitter signal cast into it. The insert 11 contains the transmitter and is seated in the sleeve 13, which serves at the same time as a connection for a follower pipe 12 which is pulled by the percussion boring machine into the earth borehole which the machine has created.

The annular insert 11 consists of an elastic and shock-absorbent plastics material. It has a pocket 14 for a block 15, preferably of a non-conductive elastic mass, for example silicone. In this elastic mass a battery 16, a transmitter 17 and a clinometer 18, for example a liquid sensor, are embedded side by side and wired together in the usual manner.

As the machine advances the striking piston 3 moves back and forth in the machine housing 1 under the influence of the compressed air supplied to the striking piston chamber 4 through the compressed air hose 9 and the control pipe 6, giving up its impact energy substantially exclusively to the front end wall 7. Only in the case of a reversal of the direction of movement, which happens relatively rarely, is the striking piston 3 controlled so as to strike the stop ring 8 with its rear end. Further details about this can be found in the German specification. It follows from this that it is only extremely rarely that the transmitter 17 with its sensitive electronics and the clinometer 18 are subjected to the effect of the ram blows of the striking piston 3. It is therefore subjected to far less mechanical stress than a transmitter mounted in the usual manner in the striking tip 2. In addition to this, as a result of the particular way in which they are arranged the transmitter 17, its battery and the clinometer 18 create practically no requirement for additional space, for the percussion boring machine in any case requires an annular connection for the follower pipe 12 and as a result of the side-by-side arrangement of battery, 16, transmitter 17 and clinometer 18 the axial length of the insert 11 is only small.

Altogether, the greatest possible protection of the sensitive transmitter and of the no less sensitive clinometer and of the battery is thus produced with practically no need for additional space. This is so even when—as in the case of very long boreholes—a great deal of energy is needed so that several batteries are required, as these can simply be disposed side-by-side.

What is claimed is:

1. A percussion boring machine comprising:

a striking piston movable reciprocatingly in a housing;

a rear stop for the striking piston;

a plurality of transmitter elements next to each other in a pocket on an opposite side of the rear stop from the striking piston, the transmitter elements being positioned inside an annular insert.

2. The percussion boring machine of claim 1, wherein the transmitter elements are embedded in an elastic mass.

3. The percussion boring machine of claim 1, wherein the pocket is closed by a cap.

4. The percussion boring machine of claim 1, wherein the transmitter elements comprise a measuring unit, a battery and a transmitter.

5. The percussion boring machine of claim 1, wherein the transmitter elements are cast into an elastic ring.

6. The percussion boring machine of claim 1, wherein the annular insert is located in a sleeve.

7. The percussion boring machine of claim 1, wherein the annular insert comprises a shock-absorbent material.

8. A percussion boring machine comprising:

a striking piston movable reciprocatingly in a housing;

a rear stop for the striking piston;

a transmitter on an opposite side of the rear stop from the striking piston, the transmitter being positioned in an annular insert inside a sleeve; and a slot in the housing in vicinity of the transmitter.

9. The percussion boring machine of claim 8, further comprising at least one transmitter element next to the transmitter.

10. The percussion boring machine of claim 8, further comprising a measuring unit and a battery.

11. The percussion boring machine of claim 8, wherein the transmitter is embedded in an elastic mass.

12. The percussion boring machine of claim 8, wherein the annular insert comprises a shock-absorbent material.

13. The percussion boring machine of claim 8, wherein the annular insert comprises an elastic ring.

14. The percussion boring machine of claim 8, wherein the sleeve is a connector for a follower pipe to be pulled by the percussion boring machine.

15. The percussion boring machine of claim 8, wherein the transmitter is arranged in a pocket in the annular insert.

16. The percussion boring machine of claim 15, wherein the pocket is closed by a cap.

* * * * *